US005585594A

United States Patent [19]

Pelham et al.

[11] Patent Number: 5,585,594

[45] Date of Patent: Dec. 17, 1996

[54] HIGH INTENSITY INFRA-RED PYROTECHNIC DECOY FLARE

[75] Inventors: Peter G. Pelham; Douglas Smith, both of Sevenoaks, England

[73] Assignee: The Secretary of State for Defence in Her Britannic Majesty's Government of the United Kingdom of Great Britain and Northern Ireland, Whitehall, England

[21] Appl. No.: 941,872

[22] Filed: Sep. 11, 1992

[30] Foreign Application Priority Data

Oct. 1, 1991 [GB] United Kingdom ..... 9120803

[51] Int. Cl.[6] ..... F42B 4/26

[52] U.S. Cl. ..... 102/336; 149/19.3; 149/116

[58] Field of Search ..... 102/336; 149/19.3, 149/116

[56] References Cited

U.S. PATENT DOCUMENTS

| | | | |
|---|---|---|---|
| 3,669,020 | 6/1972 | Waite et al. | 102/6 |
| 3,761,329 | 9/1973 | Zilcosky | 149/19.91 |
| 4,276,100 | 6/1981 | Colvin et al. | 149/109.6 |
| 4,445,947 | 5/1984 | Shaw, III et al. | 149/19.3 |
| 4,624,186 | 11/1986 | Widera et al. | 102/336 |
| 4,698,108 | 10/1987 | Vega et al. | 149/21 |
| 4,860,657 | 8/1989 | Steinicke et al. | 102/334 |
| 4,881,464 | 11/1989 | Sayles | 102/336 |
| 4,976,201 | 12/1990 | Hamilton | 102/323 |
| 5,056,435 | 10/1991 | Jones et al. | 102/336 |
| 5,129,323 | 7/1992 | Park | 102/293 |
| 5,136,950 | 8/1992 | Halpin et al. | 102/336 |

FOREIGN PATENT DOCUMENTS

| | | |
|---|---|---|
| 0173008 | 6/1985 | European Pat. Off. . |
| 0204115 | 4/1986 | European Pat. Off. . |

*Primary Examiner*—Peter A. Nelson
*Attorney, Agent, or Firm*—Nixon & Vanderhye, P.C.

[57] ABSTRACT

An aircraft-launched pyrotechnic decoy flare for luring an incoming missile away from the aircraft's exhaust which comprises a compactly clustered substantially void free array of discrete pieces of a gassy high intensity infra-red emitting pyrotechnic composition contained in a rupturable air-tight container. On ignition of the flare, combustion spreads rapidly along the interfaces between the discrete pieces to produce gaseous combustion products. When the pressure within the air-tight container reaches a predetermined level the container ruptures and the discrete pieces burst apart. The plurality of pieces have a large combined surface area over which combustion occurs and so produce a high intensity emission of infra-red radiation. In a preferred embodiment the discrete pieces comprise a mixtured fibrous activated carbon cloth impregnated with a metallic salt and coated with a mixture of an oxidizing halogenated polymer, an oxidizable metallic material and an organic binder. FIG. 1.

24 Claims, 5 Drawing Sheets

HIGH INTENSITY INFRA-RED PYROTECHNIC DECOY FLARE

BACKGROUND OF THE INVENTION

1. Field of the Invention

This invention relates to a high intensity infra-red pyrotechnic decoy flare and in particular to a decoy flare which can be aircraft launched to lure incoming missiles with infra-red seeker systems away from the aircraft exhaust which is itself an infra-red source.

2. Discussion of Prior Art

Known decoy flares conventionally comprise mixtures of fine particulate oxidisable and oxidising materials which undergo pyrotechnic reactions on ignition and which are bound together with an organic binder and pressed to form pellets. Examples of oxidisable materials are oxidisable metals, in particular magnesium and alloys thereof and examples of oxidising materials are oxidising halogenated polymers, in particular polytetrafluoroethylene (hereafter PTFE). When an incoming missile is detected by an aircraft a pellet is launched from the aircraft and is ignited as it is launched. The pellet burns over its surface to produce an infra-red source more intense than the aircraft's exhaust. If the incoming missile has an infra-red seeker system then the missile can be lured away from the aircraft exhaust to the more intensely burning pellet which falls quickly away from the aircraft.

Decoy flares can only lure a seeker system from an aircraft exhaust if the infra-red intensity of the burning pellet is greater than that of the aircraft exhaust. The velocity of the aircraft is limited if the decoy flare is to be effective because as the aircraft velocity increases the reheat of the aircraft's engines increases and the infra-red intensity of the exhaust increases. Conventional decoy flares are not able to protect an aircraft near to the maximum reheat value of its engines. This limit on the aircraft velocity is a disadvantage because it extends the time it takes an aircraft to leave a hostile region and it limits the velocity at which the aircraft can manoeuvre away from an incoming missile.

A known method of enhancing the decoy effect of conventional decoy flares is to launch two or more pellets in quick succession in order to confuse the missile seeker system with further infra-red sources. However such decoys are still not able to protect an aircraft near to the maxim reheat of its engines.

SUMMARY OF THE INVENTION

The present invention seeks to overcome at least some of the aforementioned disadvantages by providing an infra-red decoy flare which burns with an increased infra-red intensity than known decoy flares and so is able to lure seeker systems away from aircraft travelling at higher velocities than has previously been possible.

According to a first aspect of the present invention there is provided an aircraft-launched pyrotechnic decoy flare for luring an incoming missile away from the aircraft's exhaust, comprising at least one pellet which is contained within an air-tight rupturable container, characterised in that the pellet comprises a compactly clustered, substantially void free array of discrete pieces of an infra-red emitting pyrotechnic composition optionally embedded in a matrix, where the matrix, if present, or the discrete pieces, if no matrix is present, is/are made of a gassy infra-red emitting pyrotechnic composition and the container is designed to rupture and dispense the said discrete pieces when subjected to a predetermined internal pressure generated by the combustion of the gassy pyrotechnic composition. By employing a decoy flare according to the first aspect of the present invention a higher infra-red intensity results from the combustion of the pellet than from a conventional flare comprising a homogeneous pellet of the same size and same pyrotechnic composition.

When the flare according to the first aspect of the present invention is launched from an aircraft and ignited, if no matrix is present, then combustion spreads rapidly over the surface of the pellet and furthermore rapidly penetrates the pellet along the interfaces between the pieces. The gaseous products from the combustion of the pieces increases the pressure in the container which in turn increases the burning rate of the pieces so that substantially all of the pieces are ignited in a fraction of a second. When the pressure inside the container due to the build up of gaseous products reaches the said pre-determined internal pressure the container ruptures. When the container ruptures the pellet bursts apart into its constituent pieces because of the evolution of gaseous products at the interfaces between the pieces.

If a matrix is present then on ignition combustion spreads rapidly through the matrix igniting the discrete pieces as it spreads. Again the gaseous products from the combustion of the matrix, and also perhaps from the combustion of the pieces, increases the pressure inside the container which in turn increases the burning rate of the matrix. Again, all the pieces are ignited in a fraction of a second and when the pressure inside the container due to the build up of gaseous products reaches the said pre-determined internal pressure the container ruptures. When the container ruptures the pellet bursts apart into its constituent pieces because of the evolution of gaseous products between the pieces. Using a matrix is advantageous particularly if the discrete pieces are made of a pyrotechnic composition which is difficult to ignite.

The plurality of pieces have a combined surface area which is much greater than the surface area of the pellet and so the pyrotechnic composition (which combusts at its surface) which makes up the first pellet is combusted more quickly than if it was in a single homogeneous pellet. Also because of the increase in surface area the pieces are decelerated much more quickly by air resistance. This rapidly reduces the velocity of air flow over the pieces and so rapidly reduces the cooling effect of the air flow causing the pieces to burn more quickly. Therefore a pellet according to the present invention burns with a higher intensity for a shorter period of time than a single homogeneous pellet of the same pyrotechnic composition.

Preferably the gassy infra-red pyrotechnic composition has a burning rate of between 5 $cms^{-1}$ and 15 $cms^{-1}$ in air at atmospheric pressure. A pyrotechnic composition with such a high burning rate is preferable because it enables substantially all of the discrete pieces to be ignited in a fraction of a second. When all the discrete pieces are ignited, they can be dispensed and so if the pieces are ignited quickly they can be dispensed quickly and so can burn for longer after they have been dispensed thus producing an infra-red source of longer duration.

Preferably the pellet is tightly packed within the air tight container so that the gaseous combustion products produced when the gassy pyrotechnic composition combusts increases the pressure inside the container more rapidly than if air gaps were present between the pellet and the container. Such an increase in the pressure can cause the burning rate of the preferred gassy pyrotechnic composition to increase to several meters per second, thus causing the discrete pieces to be ignited more quickly.

Preferably the pre-determined internal pressure under which the container ruptures is that pressure generated by the combustion of the gassy pyrotechnic composition at the earliest time when substantially all the discrete pieces are ignited. It is advantageous that substantially all the discrete pieces are ignited before the container ruptures, because any unignited pieces cannot be ignited once the pellet bursts apart and so are wasted. Furthermore it is advantageous that the container ruptures soon after substantially all the pieces have been ignited so that when the pellet bursts apart the ignited pieces burn for as long as possible.

Preferably the discrete pieces that make up the pellet each have a volume of at least 5 $mm^3$. If the discrete pieces are smaller than this then the time it takes the cloud of burning pieces to burn out may not be long enough for the seeker system to detect and be lured to the flare.

Preferably the combined surface area of the discrete pieces that make up the pellet is between 5 and 75 times the surface area of the pellet. Within this range the deceleration of the cloud of pieces is significantly greater than the deceleration of the pellet, thus significantly reducing the cooling air flow over the burning pieces.

Preferably the air tight container comprises two container parts joined together by rupturable connection means so that the internal pressure under which the connection ruptures can be accurately predetermined. More preferably a first container part comprises a metal cylinder closed at one end and a second container part comprises a metal disc with a diameter just less than the diameter of the container and the rupturable connection means is made by crimping the open end of the cylinder over the circumference of the disc. Preferably the container is made of aluminium, titanium or alloys thereof as such metals are light in mass, strong and well suited to the particular type of rupturable connection means described above.

Preferably the discrete pieces are made of a gassy pyrotechnic composition which has a tacky consistency such that the pieces cohere to form the pellet under pressure. Pyrotechnic compositions with such a consistency are well known.

Preferably the discrete pieces are made of a mixture of fibrous activated carbon impregnated with a metallic salt and a preferred gassy infra-red emitting pyrotechnic composition comprising a mixture of an oxidising halogenated polymer and an oxidisable metallic material capable of reacting exothermically with each other on ignition to emit infra-red radiation and an organic binder.

The addition of impregnated fibrous activated carbon to a pyrotechnic composition can increase the infra-red intensity of the composition when it combusts. This is because the presence of the impregnated fibrous activated carbon increases the rate of combustion of the composition by a mechanism as yet unknown. By using the pyrotechnic composition comprising impregnated fibrous activated carbon for the discrete pieces in the present invention an infra-red output of up to 3 times that produced by a conventional flare can be produced, and so the decoy flare according to the present invention can protect an aircraft to up to the maximum reheat of the aircraft's engines. Furthermore the inclusion of impregnated fibrous activated carbon makes the flare safer to process, store and handle because the carbon is inert.

The activity of the fibrous carbon, as measured by its specific heat of wetting with silicone is preferably between 20 $Jg^{-1}$ (low activity) and 120 $Jg^{-1}$ (high activity). A fibrous activated carbon with a heat of wetting of greater than 120 $Jg^{-1}$ will have low fibre strength and on ignition may disintegrate. On the other hand using low activity fibrous activated carbon with a heat of wetting lower than 20 $Jg^{-1}$ it may be difficult to impregnate the carbon with a sufficient amount of the metallic salt.

Preferably the concentration of the metallic salt in the impregnated fibrous activated carbon is such that the impregnated fibrous activated carbon contains between 1% and 20% by weight of the metal. The presence of a metal within this range facilitates ignition and sustains the combustion of the carbon within the pyrotechnic composition. Preferably the metallic salt is a copper salt, for example, copper sulphate, copper nitrate, copper acetate and copper chloride as such salts are easily deposited onto the fibrous carbon and produce relatively high combustion rates in the fibrous carbon in atmospheres depleted of oxygen. Other metal salts can also be used, for example aluminium and zinc salts.

Preferably the fibrous activated carbon is provided in the form of activated carbon cloth. Cloth is preferable because it can be coated with the preferred pyrotechnic composition to give a uniform interface between the impregnated fibrous activated carbon and the preferred composition. Loose fibres may be less uniformly spaced and so carbon deficient parts would combust to give a relatively low infra-red intensity. As an alternative to activated carbon cloth an activated carbon felt could be coated with the preferred pyrotechnic composition to give a similar result to the cloth.

The discrete pieces preferably contain between 15% and 45% by weight of the impregnated fibrous activated carbon. Within this range a substantial part of the preferred pyrotechnic composition will be beneficially affected by direct contact with the impregnated fibrous activated carbon during combustion and the impregnated fibrous activated carbon can be completely coated with the said composition.

Preferably the matrix is made of the preferred gassy infra-red emitting pyrotechnic composition as such a pyrotechnic composition will have a high burning rate which can increase to several meters per second under pressure.

Suitable oxidising halogenated polymers are well known in the art of pyrotechnics and include polytrifluorochloroethylene and copolymers of trifluorochloroethylene with, for example, vinylidene fluoride. Similarly suitable organic binders are well known and include straight chain chlorinated paraffins, for example Alloprene (TM) and Cereclors (TM), also polyvinylychloride can be used. Suitable oxidisable metallic materials are also well known in the art of pyrotechnics and include magnesium, magnesium/aluminium alloys, aluminium, titanium, boron and zirconium.

Preferably the oxidising halogenated polymer used in the preferred pyrotechnic composition is a fluorinated polymer, for example, copolymers of tetrafluoroethylene with perfluoropropylene, homopolymers of perfluoropropylene and copolymers of perfluoropropylene with vinylidene fluoride, polyhexafluoropropylene and copolymers of hexafluoropropylene with vinylidene fluoride. More preferably the oxidising fluorinated polymer is polytetrafluoroethylene (PTFE). PTFE is a compound that is very well known in the art of pyrotechnics and has a high percentage of fluorine in it and is known to react vigorously with the oxidisable metallic materials in the group listed above.

Preferably the preferred pyrotechnic composition contains between 15% and 50% by weight of PTFE and between 35% and 70% by weight of magnesium. The ratio of oxidising halogenated polymer to oxidisable metallic material in the flare composition is generally not stochiometric. Preferably there is an excess of metallic material because at lower altitudes oxygen present in the air will react with the metallic material. Also if the organic binder is fluorinated this too will react with the metallic material.

Preferably the organic binder is a fluorinated organic binder, for example the tripolymer of vinylidene fluoride, hexafluoropropylene and tetrafluoroethylene and more preferably the fluorinated organic binder is a copolymer of vinylidene fluoride and hexafluoropropylene, for example, VITON A (TM). VITON A (TM) coats and binds the oxidising halogenated polymer and the oxidisable metallic material very well and gives the preferred pyrotechnic composition a suitable tacky consistency so that pieces of the preferred pyrotechnic composition will cohere to form the pellet under pressure.

Preferably the preferred pyrotechnic composition contains between 1% and 20% by weight of the organic binder. Generally the more organic binder that is used the safer the processing of the preferred composition is. Generally the more binder that is used the easier the preferred composition is to ignite but the combustion rate decreases. The amount of binder used can be varied to vary the tackiness of the preferred composition.

According to a second aspect of the present invention there is provided a pyrotechnic decoy flare comprising at least two pellets of a pyrotechnic composition and time delay means for igniting the pellets sequentially with a pre-determined time delay between the ignition of successive pellets, wherein at least the first ignited pellet is a pellet according to the first aspect of the present invention.

The decoy flare according to the second aspect of the present invention enhances the decoy effect of the first aspect of the present invention because launching two or more pellets in quick succession confuses the seeker system with further infra-red sources. The time delay means are arranged so that each pellet is ignited just before the proceeding pellet burns out so that the seeker system is not lured towards the aircraft exhaust between the combustion of successive pellets.

BRIEF DESCRIPTION OF THE DRAWINGS

Embodiments of the present invention will now be described with reference to the following drawings in which.

DETAILED DESCRIPTION OF PREFERRED EMBODIMENTS

A pellet according to a preferred embodiment of the present invention can be made in the following way. 20 g of VITON A (TM) is dissolved in 200 ml acetone. To the resulting solution is added 179 g of granular magnesium, 16 g of VITON A (TM), 104 g of granular grade PTFE and 26 g of lubricant grade PTFE. The resulting mixture is stirred to form a suspension which has a spreadable consistency. The suspension is then coated evenly onto 150 g of commercially available copper treated C-Tex (TM) carbon cloth which can be obtained from Siebe Gorman & Co Ltd. This is done by spreading the suspension over the cloth with a spatula. The copper treated C-Tex cloth had been impregnated with approximately 11% by weight of copper. The coated cloth is then left to dry for a few hours until the acetone has evaporated off the cloth, leaving a rubbery coating on the cloth. The coated cloth is cut into small squares having sides of 0.5 cm and 140 g of the small squares of cloth are pressed into a cylindrical pellet under a pressure of $64\times10^6$ Pa.

Figure 8:
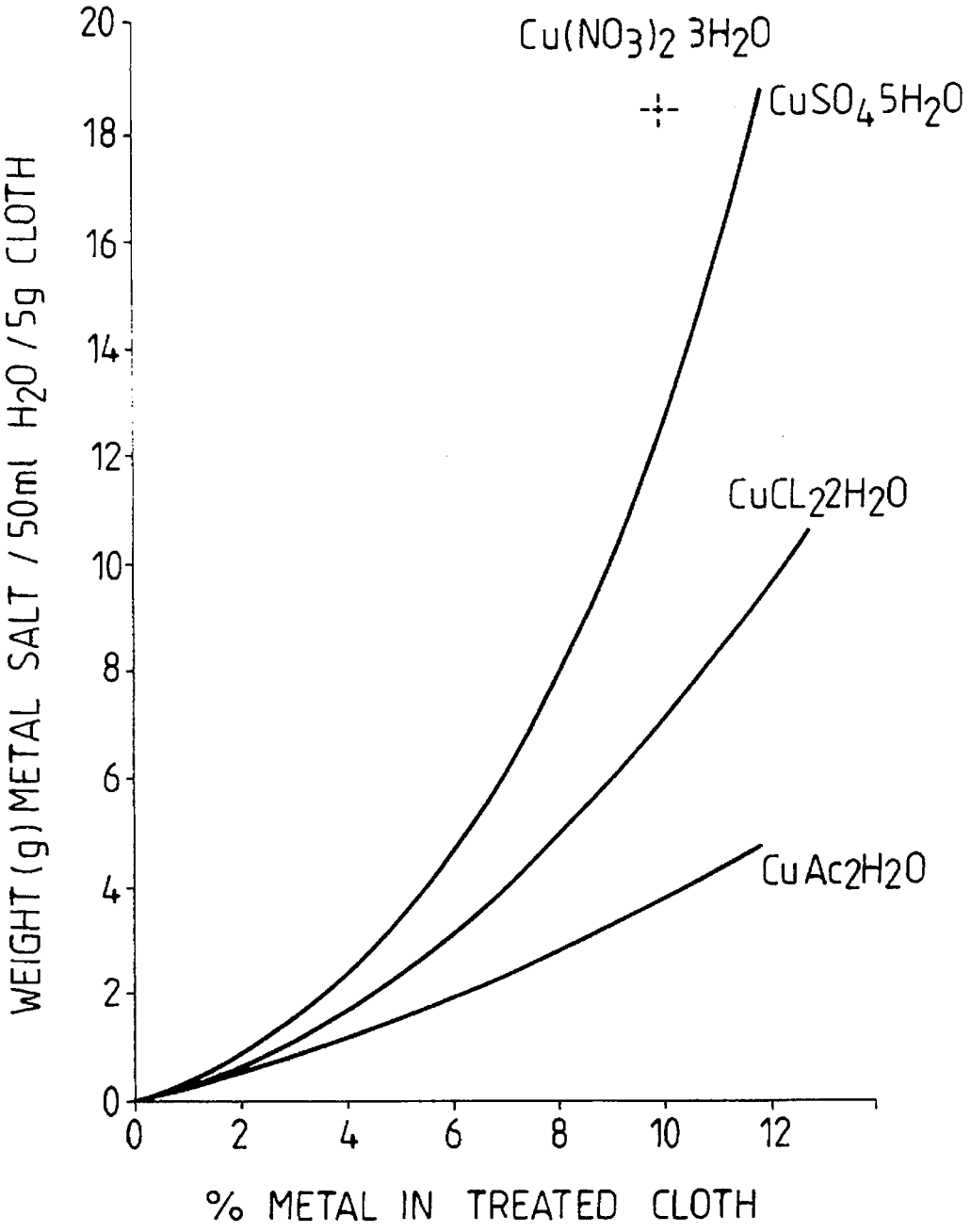
FIG. 8 is a graph of the weight of metal salt per 50 ml of water and per 5 g of charcoal cloth against the percentage of metal impregnated in the treated charcoal cloth to be used in the preferred composition for the discrete pieces in the decoy flare according to the present invention.

Alternatively the impregnated carbon cloth can be made by impregnating charcoal cloth, for example untreated C-Tex (TM) carbon cloth (also available from Siebe Gorman & Co Ltd) with water soluble metallic salts in the following way. Approximately 5 g (25×15 cm) of cloth, dried at 105° C. is immersed in 50 ml aqueous solution of the metallic salt for 2 minutes at 90° C. The fabric is then removed, drained and dried. The approximate amounts of some copper salts per 50 ml water per 5 g of dry fabric necessary to give required percentages of metal in the fabric at 60% relative humidity are shown in FIG. 8. This process can be scaled up according to the amount of carbon cloth required.

Figure 1:
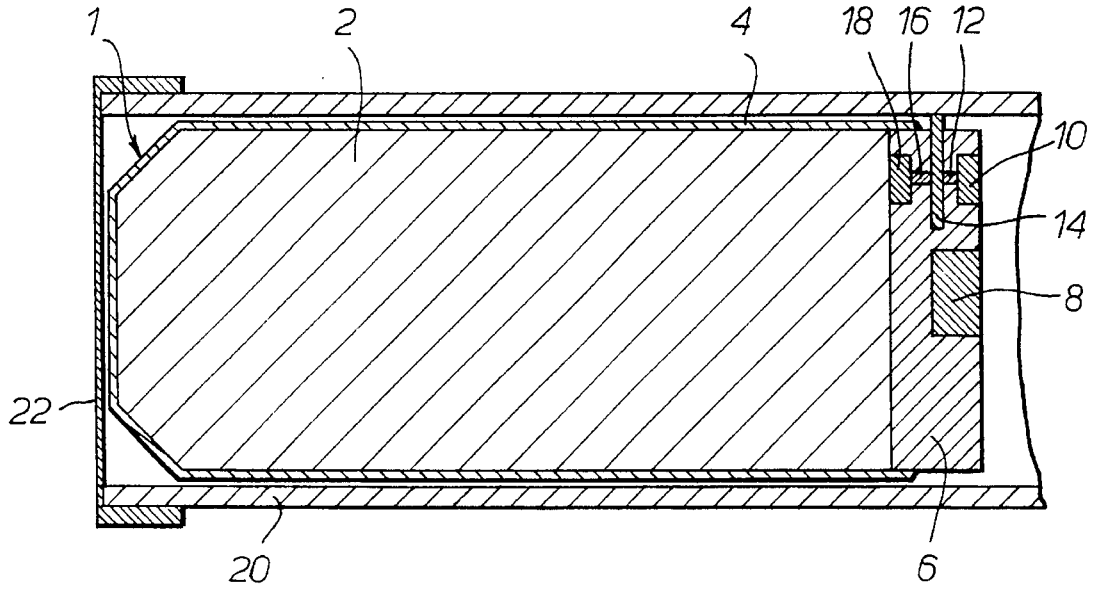
FIG. 1 is a longitudinal section through a pyrotechnic decoy flare according to the first aspect of the present invention.

Referring now to FIG. 1 the pyrotechnic decoy flare shown generally at 1 comprises a cylindrical pellet 2 constructed as described above which is located inside a cylindrical casing 4 open at its rearward end. The casing 4 is made of a low melting point aluminium alloy and has a thickness of 0.5 mm. A metallic rear plug 6 preferably made of aluminium fits into the rearward end of the casing 4 so that the rear plug 6 touches the pellet 2. The open end of the casing 4 is crimped over the circumference of the rear plug 6 to produce a rupturable connection. Holes are bored in the rear plug 6 for the location of an expulsion charge 8, a takeover charge 10, 12, 16, 18 and a sprung shutter 14. The expulsion charge 8 is a charge that produces a large volume of gas on initiation, for example a propellant charge. In this embodiment the expulsion charge 8 is a gunpowder charge. The takeover charge is made of a first explosive charge 10, a first delay train 12, a second delay train 16 separated from the first delay train 12 by a metal (preferably aluminium) sprung shutter 14 and a second explosive charge 18. The first and second explosive charges 10 and 18 respectively and the first and second delay trains 12 and 16 respectively are made of a gasless delay fuze material, for example a mixture of boron and bismuth oxide. The decoy flare 1 is located inside a cylindrical launch tube 20 which is fitted onto an aircraft. The launch tube 20 has a thin aluminium cap 22 fitted into its forward end to restrain the decoy flare 1 within the launch tube 20 until the decoy flare is launched.

In operation the aircraft detects an incoming missile and a signal from the aircraft computer initiates the expulsion charge 8 and the first explosive charge 10. The expulsion charge 8 combusts to produce a build up of hot gases at the rear of the decoy flare 1. When the hot gases reach a predetermined pressure the thin aluminium cap 22 breaks and the decoy flare 1 is accelerated along the launch tube 20. Meanwhile the first explosive charge 10 initiates the explosive train 12. When the decoy flare 1 exits the launch tube 20 the sprung shutter 14 is no longer pressed into rear plug 6 by the internal surface of the launch tube 20 and so the sprung shutter 14 is pushed out of the rear cap 6. Delay train 12 then initiates delay train 16 and delay train 16 initiates the second explosive charge 18 which in turn initiates the cylindrical pellet 2. Combustion of the pellet 2 spreads over the surfaces of the agglomerated pieces of coated cloth (ie over the surface of the pellet 2 and the interfaces between the pieces of coated cloth). The gaseous products produced by the combustion of the pieces of cloth causes the connection between the casing 4 and the rear plug 6 to rupture. Combustion at the interfaces between the pieces of cloth produces hot gaseous products and causes the pellet 2 to burst apart into its constituent pieces of burning coated cloth as it leaves the casing 4. A cloud of burning pieces of coated cloth is formed which rapidly decelerate and burn with a high infra-red intensity for a short period of time.

Figure 3:
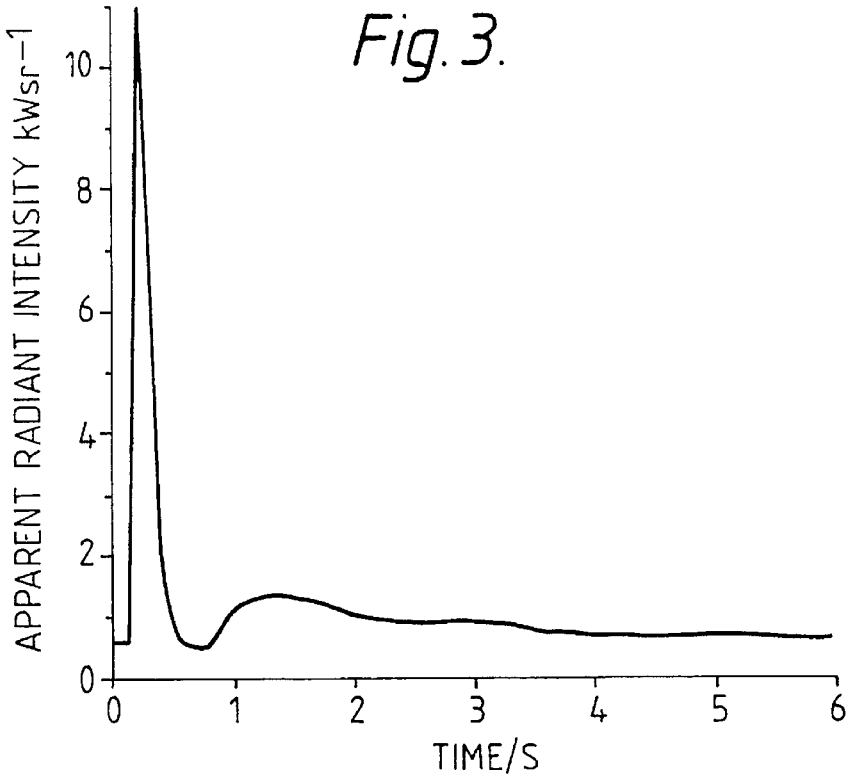
FIG. 3 is a graph of radiant intensity against time when the pyrotechnic flare shown in FIG. 1 is ignited at an altitude of 300 m and a velocity of 200 $ms^{-1}$.

Referring now to FIG. 3 which shows how the radiant intensity in the 3 to 5 μm wavelength range varies with time when the decoy flare shown in FIG. 1 is launched and ignited from an aircraft at a velocity of 200 $ms^{-1}$ and an altitude of 300 m. As can be seen the cloud of coated carbon cloth pieces burns with an intensity of up to 11 $kWsr^{-1}$ for a period of approximately 0.2 seconds.

Figure 2:
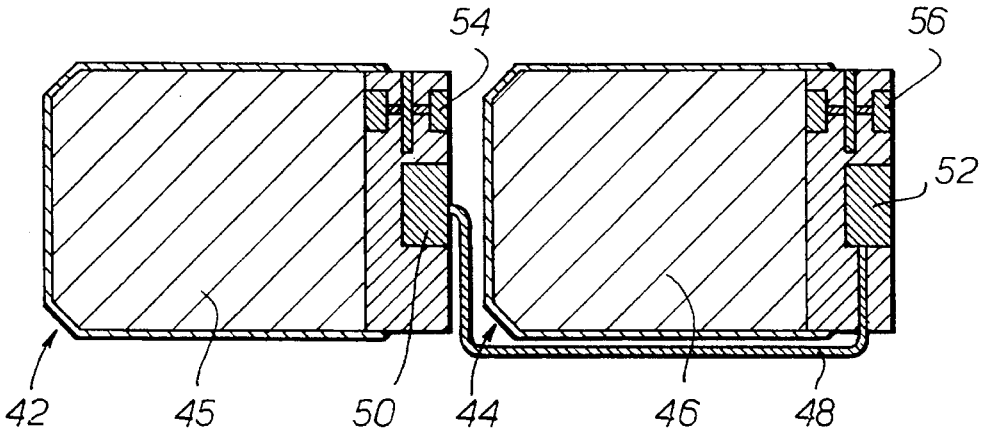
FIG. 2 is a longitudinal section through a double pyrotechnic decoy flare according to the second aspect of the present invention.

Referring now to FIG. 2 which shows a first decoy flare shown generally at 42 and a second decoy flare shown generally at 44. The first and second decoy flares 42 and 44 respectively are similar to the decoy flare 1 shown in FIG. 1 except that the cylindrical pellet 46 is made of a homogeneous pressed MTV composition similar to that which is coated onto the carbon cloth. A time delay fuze 48 made of a length of igniter cord that takes 0.2 seconds to burn along its length connects expulsion charge 50 of decoy flare 42 and expulsion charge 52 of decoy flare 44.

In operation the aircraft detects an incoming missile and a signal from the aircraft computer initiates the expulsion charge 50 and explosive charge 54. The expulsion charge 50 initiates the time delay fuze 48. The first decoy flare 42 is launched and ignited as described above for decoy flare 1. The time delay fuze 48 burns along its length and initiates expulsion charge 52 and explosive charge 56 0.2 seconds after expulsion charge 50 and explosive charge 54 were initiated. The second decoy flare 44 is then launched as described for decoy flare 1.

Figure 4:
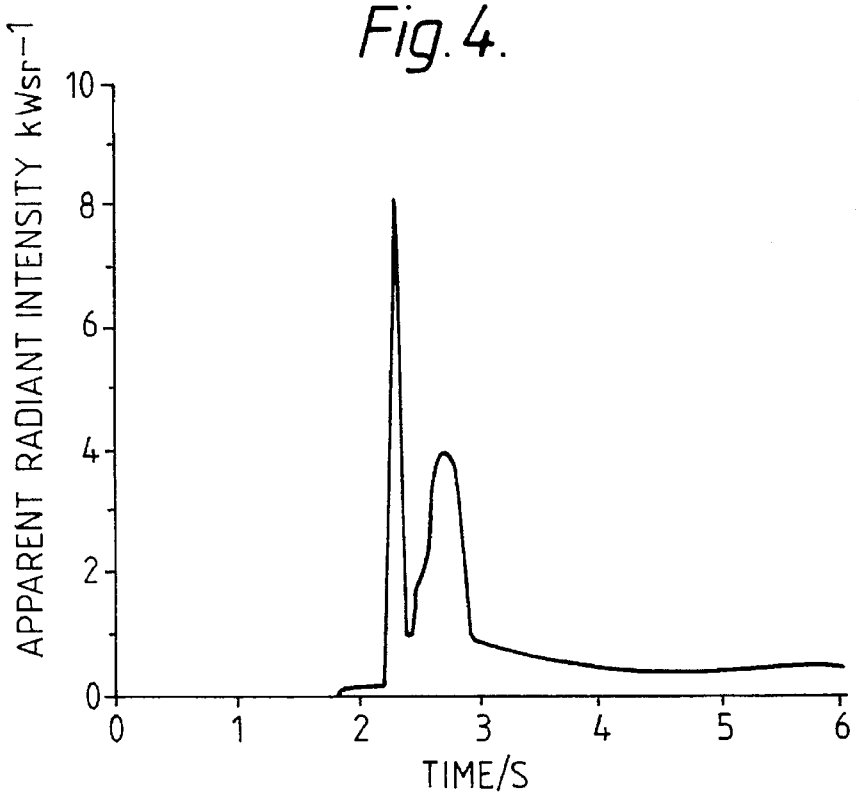
FIG. 4 is a graph of radiant intensity against time when the pyrotechnic flare shown in FIG. 2 is ignited at an altitude of 300 m and a velocity of 200 $ms^{-1}$.

Referring now to FIG. 4 which shows how the radiant intensity in the 3 to 5 μm wavelength range varies with time when the decoy flare shown in FIG. 2 is launched and ignited from an aircraft at a velocity of 200 $ms^{-1}$ and an altitude of 300 m. The initial spike corresponds to the spike in FIG. 3 and is produced by the first flare 42. While the first pellet is burning the aircraft can be manoeuvred so that the infra-red intensity of the aircraft exhaust as seen from the direction of the seeker system is reduced. The time delay between the initiation of the flares 42 and 44 is chosen so that when the first flare 42 burns out the second flare 44 is burning and acting as an infra-red source. This corresponds to the second rise in infra-red intensity shown in FIG. 4 which lasts for 0.5 seconds. If the aircraft is successfully manoeuvred the flare 44 will be the brightest infra-red source the seeker system sees and so the seeker system will be lured towards the pellet 46 instead of the aircraft.

Figure 5:
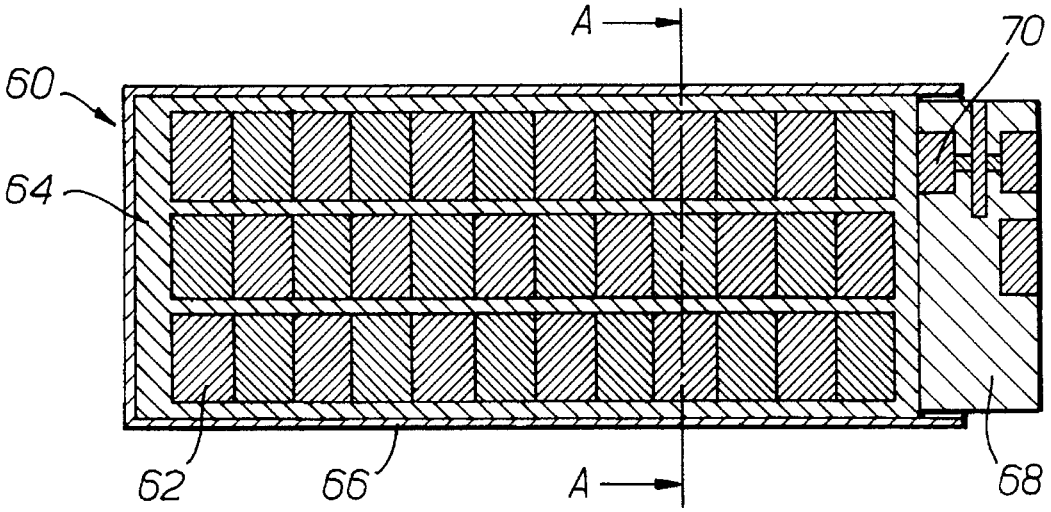
FIG. 5 is a longitudinal section through a second embodiment of the pyrotechnic decoy flare according to the first aspect of present invention.
Figure 6:
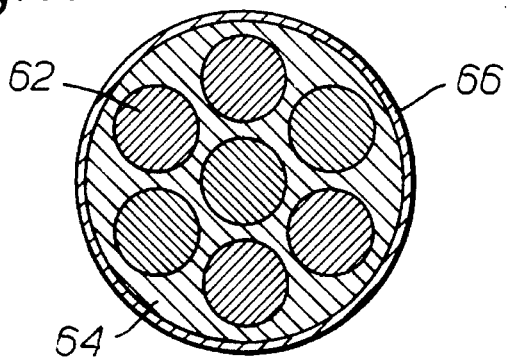
FIG. 6 is a section along line AA of FIG. 5.

Referring now to FIGS. 5 and 6 which shows a further embodiment of the first aspect of the present invention. The flare shown generally at 60 comprises 91 pieces 62 (approximately 345 g) made of a gassy pyrotechnic composition (hereafter referred to as composition A) potted in a matrix 64. The pieces 62 are cylindrical with a diameter of 14 mm and a length of 11 mm. The gassy pyrotechnic composition A is made in the following way. 25 g of VITON A (TM) is dissolved in 250 ml of acetone, the solution is stirred vigorously. More acetone can be added throughout the process to give the mixture a consistency so that it is easily stirrable and to replace acetone that evaporates. 275 g of granular magnesium, 120 g of granular grade PTFE and 80 g of lubricant grade PTFE are added to the solution, while continuing to stir the mixture vigorously. Then 1200 ml hexane is added and the magnesium, PTFE, VITON A (TM) composition (the composition A) precipitates out of the mixture. The composition A is separated from the hexane/acetone solution by filtration under vacuum. The pyrotechnic composition A is washed three times with 1200 ml of hexane which is filtered off under vacuum each time. The composition A is then left to dry.

When it is dry the composition A is pressed under a pressure of approximately $64\times10^6$ Pa to form the individual pieces 62. The pieces 62 are then potted in the matrix 64 which is made of the same composition that is coated onto the impregnated activated carbon cloth as described above. The pieces 62 are arranged in the matrix 64, as shown in FIGS. 5 and 6, in 7 cylinders, each cylinder being made of 13 pieces 62 stacked on top of one another.

The pieces 62 and matrix 64 are located within an aluminium casing 66, with a diameter of 50 mm and a length of 160 mm, the casing having a thickness of 0.5 mm. A rear plug 68 identical to the rear plug 6 shown in FIG. 1 is fitted into the open rearward end of the casing 66.

In operation the flare 60 is launched and initiated as described above for the decoy flare 1. The second explosive charge 70 initiates the matrix 64. The combustion of the matrix 64 spreads quickly and ignites the pieces 62 which combust over their surface. Combustion of the matrix 64 and the pieces 62 produce hot gaseous products which cause the rear plug 68 and pellet 60 fly out of the open end of the casing 66 and causes the pellet 60 to burst apart into its constituent pieces 62 of burning pyrotechnic composition A. A cloud of pieces 62 of burning pyrotechnic composition A is formed which rapidly decelerates and burn with a high infra-red intensity for a short period of time.

Figure 7:
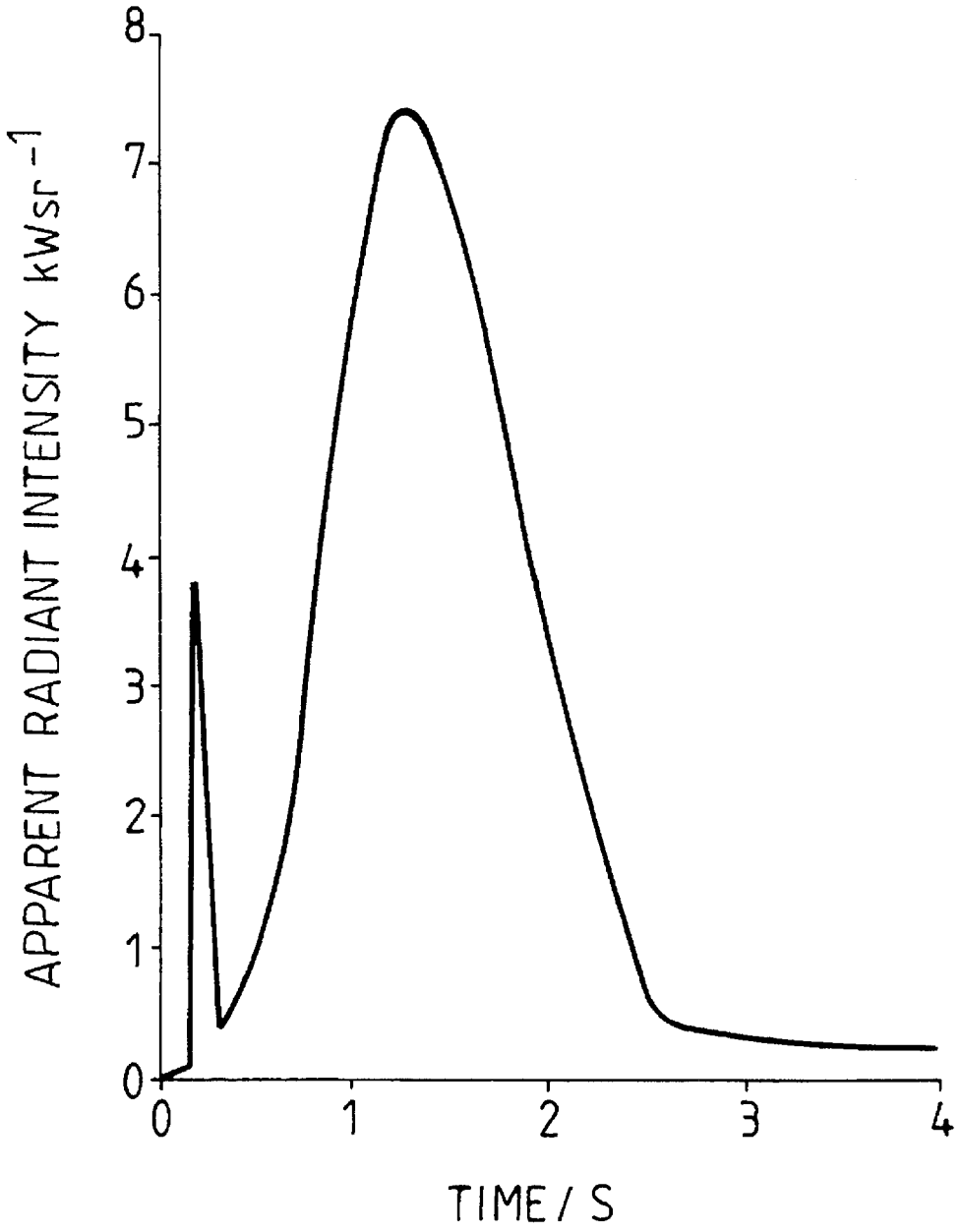
FIG. 7 is a graph of radiant intensity against time when the pyrotechnic decoy flare shown in FIGS. 5 and 6 is ignited at an altitude of 300 m and a velocity of 200 $ms^{-1}$.

Referring now to FIG. 7 which shows how the radiant intensity in the 3 to 5 μm wavelength range varies with time when the decoy flare 60 shown in FIGS. 5 and 6 is launched and ignited from an aircraft at a velocity of 200 $ms^{-1}$ and an altitude of 300 m. The initial spike corresponds to the combustion of the matrix 64. As can be seen the cloud of pieces 62 burns with an intensity of up to 7.5 $kWsr^{-1}$ for a period of approximately 2 seconds.

We claim:

1. An aircraft-launched pyrotechnic decoy flare for luring an incoming missile away from the aircraft's exhaust, comprising:

a pellet, comprising a compactly clustered, substantially void free array of discrete pieces, said discrete pieces being made of a gassy infra-red emitting pyrotechnic composition, and an air-tight container for containing said pellet, said container and said discrete pieces comprising a means for causing said container to rupture and dispense said discrete pieces when subjected to a pre-determined internal pressure generated, at least partly, by combustion of said discrete pieces.

2. A pyrotechnic decoy flare according to claim 1 wherein the gassy infra-red emitting pyrotechnic composition has a burning rate of between 5 $cms^{-1}$ and 15 $cms^{-1}$ in air at atmospheric pressure.

3. A pyrotechnic decoy flare according to claim 1 wherein the pellet additionally comprises a matrix in which said discrete pieces are embedded, said matrix being made of a gassy infra-red emitting pyrotechnic composition.

4. A pyrotechnic decoy flare according to claim 3 wherein the gassy infra-red emitting pyrotechnic composition from which the matrix is made has a burning rate of between 5 $cms^{-1}$ and 15 $cms^{-1}$ in air at atmospheric pressure.

5. A pyrotechnic decoy flare according to claim 1 wherein the pellet is tightly packed within the air-tight container.

6. A pyrotechnic decoy flare according to claim 1 wherein the pre-determined internal pressure is that pressure generated by the combustion of the pellet at the earliest time when substantially all of the discrete pieces are ignited.

7. A pyrotechnic decoy flare according to claim 1 wherein the discrete pieces each have a volume of at least 5 $mm^3$.

8. A pyrotechnic decoy flare according to claim 1 wherein the combined surface area of the discrete pieces is between 5 and 75 times the surface area of the pellet.

9. A pyrotechnic decoy flare according to claim 1 wherein the air-tight container comprises two container parts joined together by rupturable connection means.

10. A pyrotechnic decoy flare according to claim 9 wherein a first container part comprises a metal cylinder closed at one end, and a second container part comprises a metal disc with a diameter just less than the diameter of the cylinder and the rupturable connection means is made by crimping the open end of the cylinder over the circumference of the disc.

11. A pyrotechnic decoy flare according to claim 1 wherein the container is made of aluminium, or titanium or alloys thereof.

12. A pyrotechnic decoy flare according to claim 1 wherein the discrete pieces are made of a pyrotechnic composition which has a tacky consistency such that the pieces cohere to form the pellet under pressure.

13. A pyrotechnic decoy flare according to claim 1 wherein the discrete pieces are made of a mixture of fibrous activated carbon impregnated with a metallic salt and a preferred gassy infra-red emitting pyrotechnic composition which comprises a mixture of an oxidising halogenated polymer and an oxidisable metallic material capable of reacting exothermically with each other on ignition to emit infra-red radiation and an organic binder.

14. A pyrotechnic decoy flare according to claim 13 wherein the concentration of the metallic salt in the impregnated fibrous activated carbon is such that the impregnated fibrous activated carbon contains between 1% and 20% by weight of the metal.

15. A pyrotechnic decoy flare according to claim 13 wherein the metallic salt is a copper salt.

16. A pyrotechnic decoy flare according to claim 13 wherein the fibrous activated carbon is activated carbon cloth.

17. A pyrotechnic decoy flare according to claim 13 wherein the pyrotechnic composition contains between 15% to 45% by weight of the impregnated fibrous activated carbon.

18. A pyrotechnic decoy flare according to claim 13 wherein the halogenated polymer is polytetrafluoroethylene (hereafter PTFE).

19. A pyrotechnic decoy flare according to claim 13 wherein the oxidisable metallic material is magnesium.

20. A pyrotechnic decoy flare according to claim 13 wherein the pyrotechnic composition contains between 15% to 50% by weight of PTFE and between 38% and 70% by weight of magnesium.

21. A pyrotechnic decoy flare according to claim 13 wherein the organic binder is a copolymer of vinylidene fluoride and hexafluoropropylene.

22. A pyrotechnic decoy flare according to claim 13 wherein the pyrotechnic composition contains between 1% and 20% by weight of the organic binder.

23. A pyrotechnic decoy flare according to claim 3 wherein the matrix comprises a mixture of an oxidising halogenated polymer and an oxidisable metallic material capable of reacting exothermically with each other on ignition to emit infra-red radiation and an organic binder.

24. A pyrotechnic decoy flare comprising at least two pellets of a pyrotechnic composition and time delay means for igniting the pellets sequentially with a pre-determined time period between ignition of successive pellets, wherein at least the first ignited pellet is a pellet according to claim 1.

* * * * *